United States Patent [19]

Takahashi

[11] Patent Number: 4,863,298

[45] Date of Patent: Sep. 5, 1989

[54] ELECTRONIC APPARATUS FOR OUTPUTTING INFORMATION WITH EQUAL SPACES BETWEEN GROUPS THEREOF

[75] Inventor: Tsutomu Takahashi, Kawasaki, Japan

[73] Assignee: Canon Kabushiki Kaisha, Tokyo, Japan

[21] Appl. No.: 183,274

[22] Filed: Apr. 11, 1988

Related U.S. Application Data

[63] Continuation of Ser. No. 811,767, Dec. 20, 1985, abandoned.

[30] Foreign Application Priority Data

Dec. 24, 1984 [JP] Japan ..... 59-271050

[51] Int. Cl.[4] ..... B41J 21/00

[52] U.S. Cl. ..... 400/279; 400/76

[58] Field of Search ..... 400/3, 9, 12, 13, 64, 400/76, 279, 342, 708

[56] References Cited

U.S. PATENT DOCUMENTS

| | | | |
|---|---|---|---|
| 2,484,649 | 10/1949 | Root, III | 400/12 X |
| 2,797,787 | 7/1957 | Higonnet et al. | 400/12 X |
| 3,999,164 | 12/1976 | Kashio | 400/279 X |
| 4,031,996 | 6/1977 | Busch | 400/279 |
| 4,051,945 | 10/1977 | Fujimoto et al. | 400/279 |
| 4,298,290 | 11/1981 | Barnes et al. | 400/12 X |
| 4,334,286 | 6/1982 | Kerigan et al. | 400/279 X |
| 4,484,826 | 11/1984 | Horn et al. | 400/279 |
| 4,540,299 | 9/1985 | Yamada | 400/279 X |
| 4,556,332 | 12/1985 | Maekawa | 400/12 X |
| 4,564,304 | 1/1986 | Ueno | 400/279 |

FOREIGN PATENT DOCUMENTS

| | | | |
|---|---|---|---|
| 0187573 | 9/1985 | Japan | 400/12 |

OTHER PUBLICATIONS

IBM Technical Disclosure Bulletin, "Column Layout Control For an Electronically Controlled Typewriter", Clancy et al., vol. 17, No. 12, May 1975, pp. 3625–3629.

IBM Technical Disclosure Bulletin, "Variable Tabs for Justification", Wheeler, vol. 19, No. 6, Nov. 1976, p. 1965.

IBM Technical Disclosure Bulletin, "Algorithmic Justification for a Printing Subsytem", Tetiva, vol. 21, No. 11, Apr. 1979, pp. 4642–4644.

*Primary Examiner*—Ernest T. Wright, Jr.

*Attorney, Agent, or Firm*—Fitzpatrick, Cella, Harper & Scinto

[57] ABSTRACT

An electronic apparatus includes an output unit for outputting information, a designation unit for dividing information to be outputted from the output unit on one line into a plurality of information sections an designating the width of each divided information section, and an output space set unit for allocating well-proportioned and equal spaces between the widths of divided information sections designated by the designation unit.

12 Claims, 6 Drawing Sheets

START
S1
KEY INPUT ?
N
Y
S2
SET START KEY INPUT ?
N
Y
ANOTHER PROCESS
S3
(COUNT) ← 0
(LENGTH) ← 0
A
S4
KEY INPUT ?
N
Y

ELECTRONIC APPARATUS FOR OUTPUTTING INFORMATION WITH EQUAL SPACES BETWEEN GROUPS THEREOF

This application is a continuation, of application Ser. No. 811,767 filed 12/20/85, now abandoned.

BACKGROUND OF THE INVENTION

1. Field of the Invention

The present invention relates to an electronic apparatus provided with means for outputting information every one line after another and allocating well-proportioned and equal spaces between groups of outputted information.

2. Description of the Prior Art

Recent development in electronic technology, typically in semiconductor integration technology, has made it possible to produce various apparatus in place of a conventional mechanical key-input typewriter, such as an electronic typewriter provided with a function to edit input data in addition to a conventional typewriter function, a word processor with a versatile function and the like.

An apparatus having a column layout function is known among these apparatus, which can make, for example, well-proportioned tables with equal spaces, e.g., three spaces allocated between adjoining columns by merely inputting the most lengthy word, phrase or numeral of each column.

The conventional column layout function, however, performs allocation of spaces between adjoining columns always by inserting the same amount of space. Therefore, if for example, the number of columns on one line is small or the length of column is short, space is left at the right side of the line so that the column layout is not made well-proportioned. If wider space between columns is desired, it is necessary to input additional spaces after the most lengthy word or numeral in each column.

SUMMARY OF THE INVENTION

It is an object of the present invention to provide an electronic apparatus in which when information to be outputted in one line is divided into several parts, well-proportioned and equal spaces between parts of information is allocated.

It is another object of the present invention to provide an electronic apparatus capable of keeping equal blanks at partition positions where character strings inputted by input means are partitioned.

It is still another object of the present invention to provide an electronic apparatus capable of calculating and storing the amount of space at partition positions where character strings inputted by input means are partitioned.

It is still another object of the present invention to provide an electronic apparatus capable of keeping equal spaces between columns while visually recognizing character strings.

It is still another object of the present invention to provide an electronic apparatus capable of determining a column layout based on the right and left margins and the number of partitions of character strings while visually recognizing them.

DETAILED DESCRIPTION OF THE PREFERRED EMBODIMENTS

A preferred embodiment of the present invention will be described with reference to the accompanying drawings.

Figure 1:
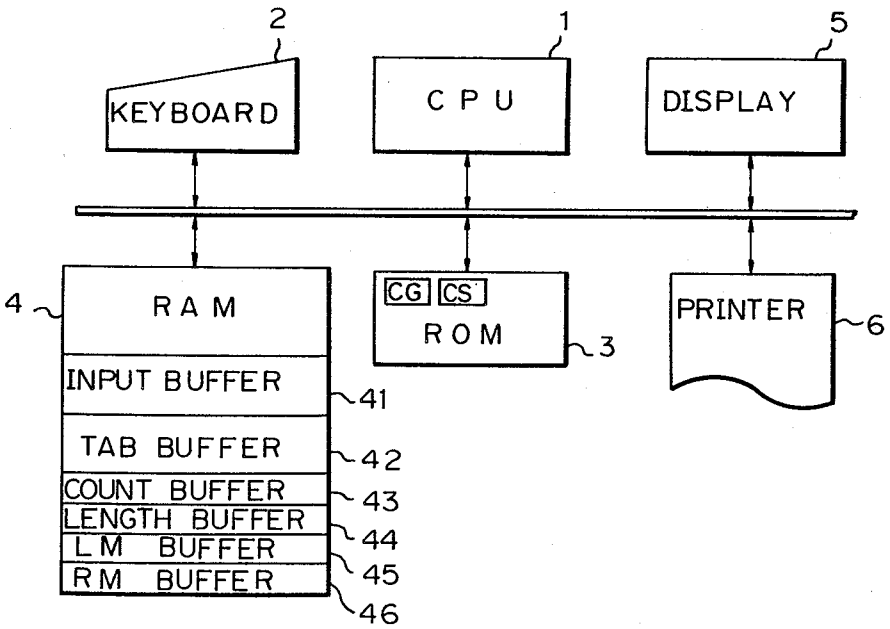
FIG. 1 is a block diagram showing an embodiment of the electronic apparatus according to the present invention.
Figure 1A:
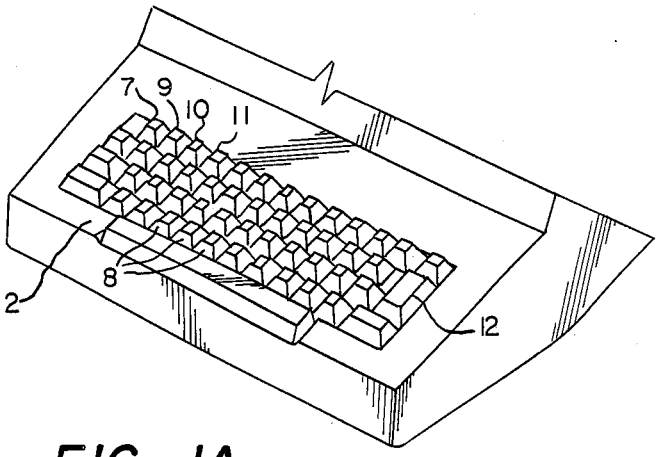
FIG. 1A is a keyboard of the type used in the present invention.
Figures 3, 3A, 3B:
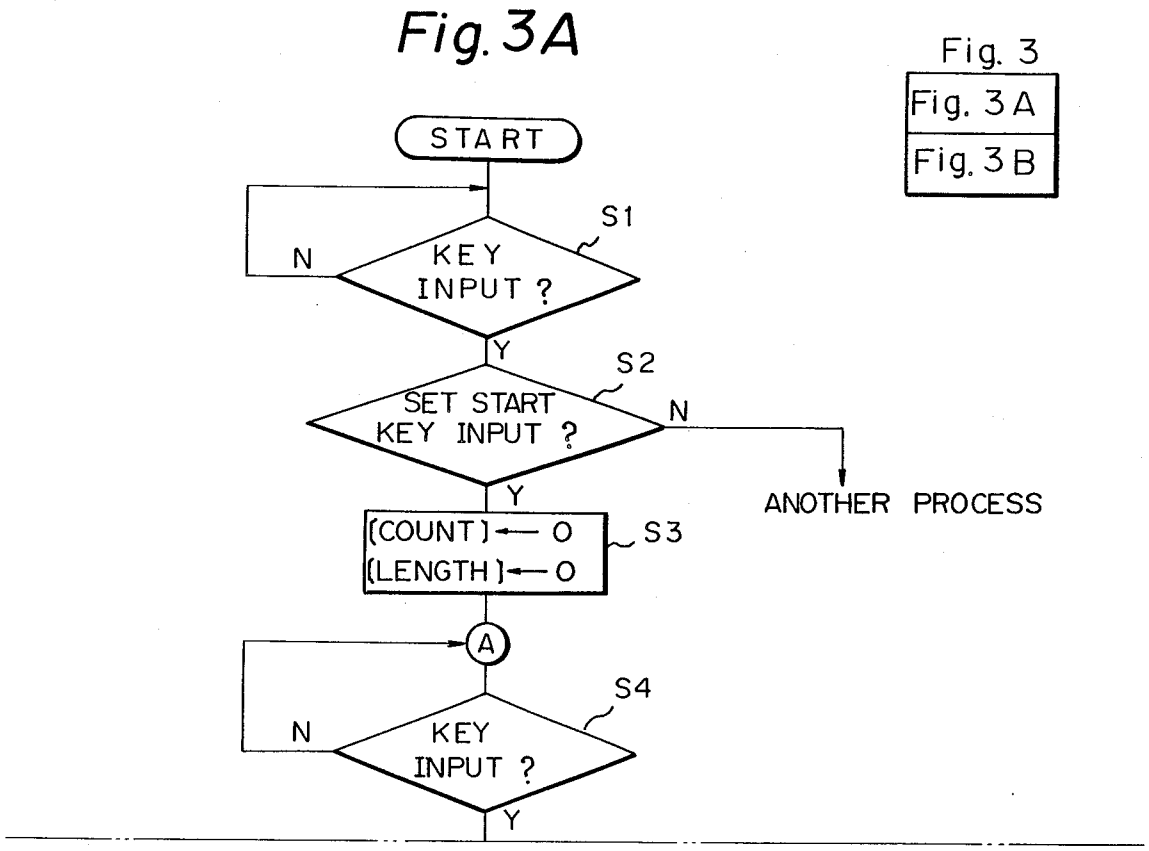
FIG. 3 is a schematic block diagram showing the relative locations of FIGS. 3A and 3B.
FIG. 3A and 3B represents a flow chart showing column layout processes of the embodiment.
Figure 3B:
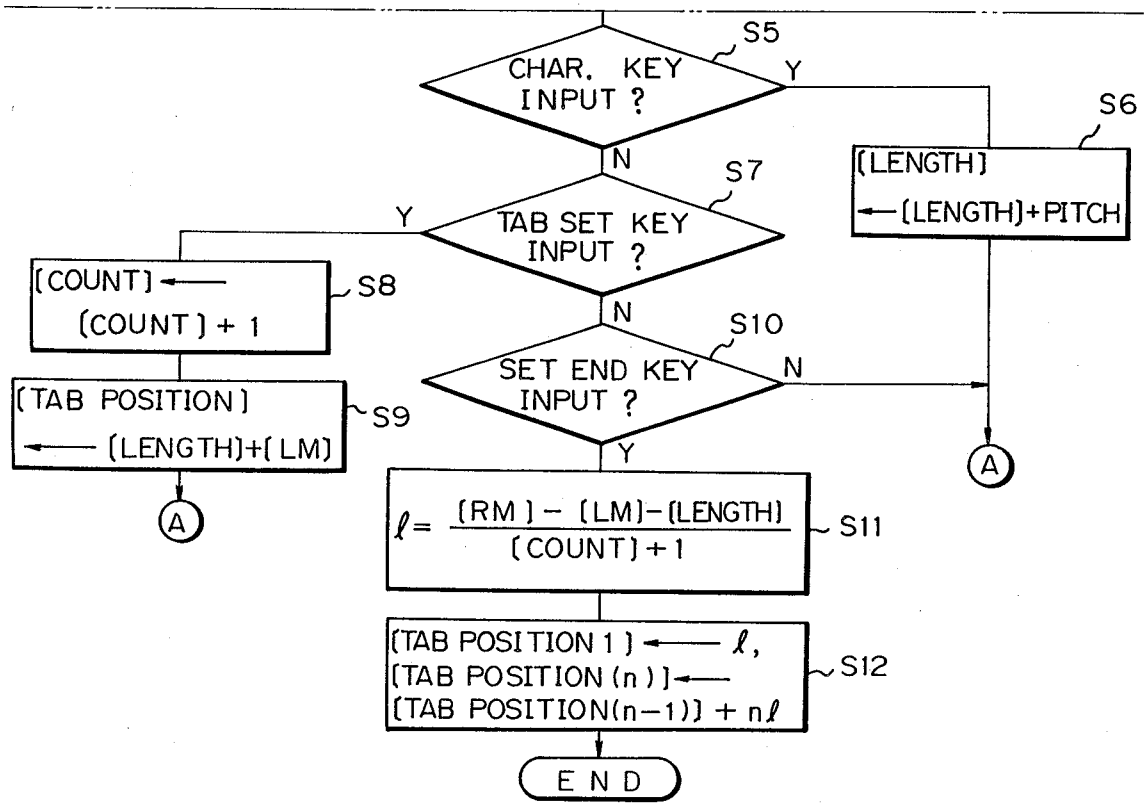
Figure 5:
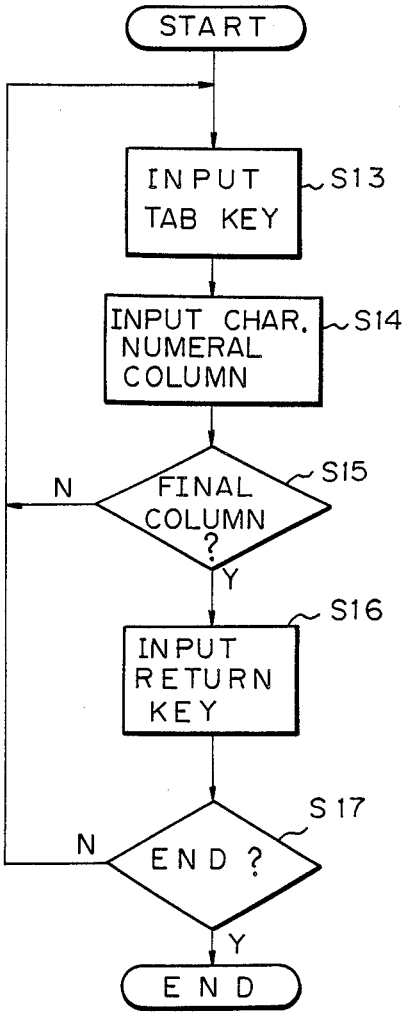
FIG. 5 is a flow chart illustrating input control to the columns arranged by the column layout of the embodiment.

FIG. 1 is a block diagram showing an embodiment of the electronic apparatus according to the present invention. In the figure, a control unit 1 (hereinafter referred to as CPU) controls the whole circuitry of the apparatus. A keyboard 2 is for inputting information. A read-only memory (ROM) 3 stores the control sequence (CS) of CPU1 as shown in FIGS. 3A and 3B and 5, pattern information (from character generator (CG)) such as characters inputted from the keyboard 2 and the like. A random access memory (RAM) 4 includes an input buffer 41 holding data inputted from the keyboard 2, a tab buffer 42 storing tab positions, a count buffer 43, a length buffer 44, a left margin (LM) buffer 45 storing a left margin position and a right margin (RM) buffer 46 storing a right margin position. A display 5 displays data inputted from the keyboard 2, edited data and the like. A printer 6 prints out the edited data.

Figure 2:
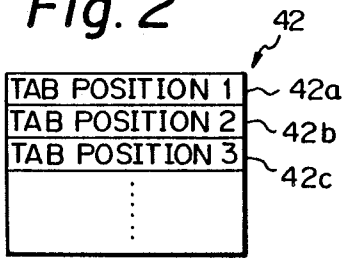
FIG. 2 is a detailed construction of the tab buffer of the embodiment.

The detail of the tab buffer 42 of RAM 4 is shown in FIG. 2. As specifically shown in FIG. 2, the tab set positions along the line are stored in the order of tab position 1 (42*a*), tab position 2 (42*b*), tab position 3 (42*c*), . . .

The column layout control to be performed by the electronic apparatus constructed as above will be described with reference to the flow chart of, FIGS. 3A and 3B.

At step S1, a key input from the keyboard 2 is waited for. If there is a key input, at step S2, it is judged whether the key input is a "set start" key 7 or not. If not, another process corresponding to the key input is executed. If affirmative, step S3 follows to perform column layout processes.

At step S3, the count buffer 43 and the length buffer 44 are cleared. At the next step S4, a key input from the keyboard 2 is waited for. If there is a key input, step S5 follows to check if the key input is from a character key 8 or not. In case of a character key 8, then step S6 follows.

The column layout herein referred to means to arrange a necessary number of columns between the left margin position previously set at the left margin buffer 45 and the right margin position previously set at the right margin buffer 46. It is necessary to input the most lengthy word, phrase or numeral in each column. At first, the most lengthy character string among those in the first column is inputted. If a first character is inputted, at step S6, a character pitch or width of one character (along the line) on a display 5 or a printer 6 is added to the content of the length buffer 44. Then returning back to step S4, the next key input is waited for.

After completion of inputting the most lengthy character string in the first column, a "partition" key 9 (tab set key) on the keyboard 2 is actuated to indicate the end of setting the column length. Upon input of the "partition" key 9, step S7 and then step S8 follow step S5. At step S8, since the first column has been set, the count buffer 43 is incremented by 1. At step S9, the content of the length buffer 44 and that of the left margin buffer 45 are added together to store the result in the tab buffer 42. In this step, such results are sequentially stored in the order of the tab position 1 (42*a*) at the end of setting the first column after start of the column layout, the tab position 2 (42*b*) at the end of the setting the second column, the tab position 3 (42*c*) at the end of setting the third column, and so on. (These tab positions are interim positions.) After storing the tab position, step S4 resumes to wait for a next key input.

The setting of the column widths are thus sequentially performed by actuating character keys 8 and the "partition" key (tab set key). After setting all of the column widths and after the last input of the "partition" key 9, a "set end" key 10 is actuated. The "set end" key 10 may be used in common with the "set start" key 7. Upon input of the "set end" key 10, steps S5, S7, S10 and S11 follow step S4. At step S11, the amount of space (blank), between columns and between the right and left margin positions and adjoining columns, is determined based on the widths of the columns thus inputted and the right and left margin positions. As described above, the length buffer 44 is storing the sum of character pitchs inputted by the character keys 8, i.e., the width of the columns on one line as inputted, while the count buffer 43 is storing the number of columns as inputted. Therefore, by subtracting the content of the left margin buffer 45 from the content of the right margin buffer 46, the total width within which a column layout is to be performed is determined. The total width is then subtracted by the content of the length buffer 44 to decide the amount of residual space within the total width. Thereafter, by dividing the amount of residual blank by (the number of columns +1), the amount l of blank (space), between columns and between the right and left margin positions and adjoining columns, is determined.

Next, at step S12, actual tab positions are determined based on the amount l of blank. At each tab position n of the tab buffer 42, already stored at step S9 are the interim tab positions, i.e., the head positions of the columns counted from the left margin position without considering the amount of blank. At step S12, the result of calculation [(tab position n - 1) +nl] is stored in (the tab position n). l is stored at the tab position 1.

With the above processes, a column layout is accomplished wherein the same amount of blank portion, between columns and between the right and left margin positions and adjoining columns, is inserted.

In case of a key input other than a "set end" key input, i.e., in case of an unnecessary key input at step S10, no process advances but only a "set end" key input is waited for.

Figure 4:
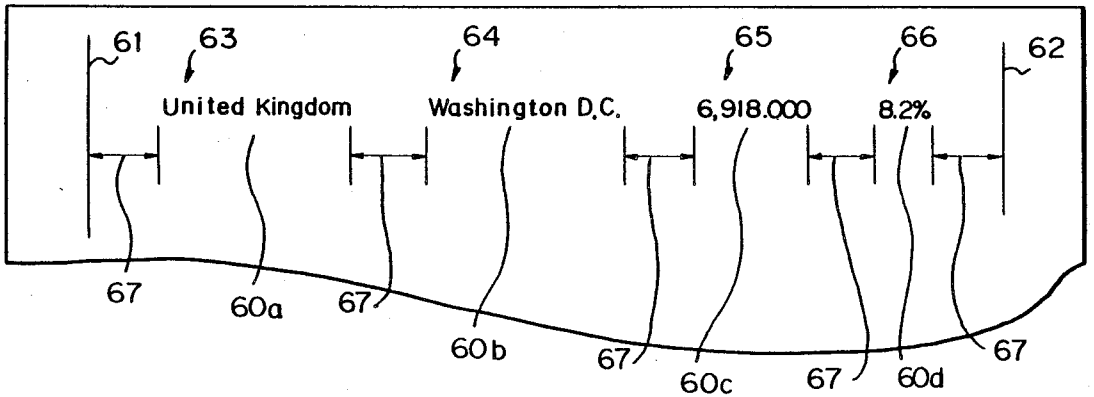
FIG. 4 shows an example of a column layout of the embodiment.

An example of the column layout of the embodiment is illustrated in FIG. 4, wherein the number of columns is 4. In the figure, reference numeral 61 represents the left margin identified by the left margin buffer 45, and reference numeral 62 represents the right margin identified by the right margin buffer 46. References 60*a* to 60*d* denote examples of the most lengthy word, phrase, and numeral in each column, and reference numerals 63 to 66 denote the tab head positions of the columns.

As seen from FIG. 4, the blank portions, designated by 67 and defined by two arrows, are equal in length between columns and between the right and left margin positions 61, 62 and adjoining columns.

FIG. 5 shows the operation sequence for making for example a table using the columns set in accordance with the control shown in FIGS. 3A and 3B.

First, at step S13, an output position is advanced to the head of the first column by actuating the tab key 11 and referring to the tab buffer 42. At step S14, a character or numeral string is inputted. The inputted character or numeral string is printed out. By repeating step S13 and S14 for each column, character or numeral strings can be outputted with blank portions 67 inserted between columns and between the right and left margin positions and adjoining columns. After the last column on one line is inputted, step S16 follows step S15. Then, at step S16, a return key 12 is actuated to move to the next line. Thereafter, up to the last line, which is determined at step S17, the processes at steps S13, S14, S15, S16 and S17 are repeated to arrange the character or numeral strings in each column in a well-proportioned symmetry.

As described in the foregoing, the tab positions are decided merely by inputting the character or numeral strings of the columns, with the amount of blank (space) between columns automatically allocated. Therefore, a table for example can be made in a well-proportioned symmetry irrespective of the number of characters or numerals. The character and numeral strings obtained by the column layout may be outputted to the display 5 and the printer 6.

As seen from the above description of the invention, an electronic apparatus is realized which can deliver, one line after another, divisionally and well-proportionately output information from an output means. Specifically, when the apparatus is used for the column layout by a document processing apparatus, it is possible to obtain an output display exceptionally fine in layout.

What I claim is:

1. An electronic apparatus comprising:

input means for inputting character data;

memory means for storing and accumulating a character pitch of said input character data for each input of said character data from said input means;

indication means for indicating partitions in said character data in the process of inputting said character data from said input means by reference to accumulation of said character pitch stored in said memory means;

calculation means for making equal blanks between the partitions in said character data; and tab position setting means for setting tab positions at said partitions in said character data determined on the basis of the formation of said blanks.

2. An electronic apparatus according to claim 1, wherein said input means includes a keyboard.

3. An electronic apparatus according to claim 1, wherein said electronic apparatus has storage means for storing character data inputted from said input means.

4. An electronic apparatus according to claim 1, wherein said electronic apparatus has output means for outputting character data in accordance with the calculation result of said calculation means.

5. An electronic apparatus comprising:

input means for inputting character data;

memory means for storing and accumulating character pitch of said input character data for each input of said character data from said input means;

count means for counting the number of partitions of character data input from said input means;

indication means for indicating partitions in said character data input from said input means;

calculation means for calculating the amount of space based on the number of partitions indicated by said count means by reference to said memory means; and tab setting means for setting tabs at respective positions of the partitions in said character data determined on the basis of the accumulated character pitch stored in said memory means and the number of partitions counted by said count means.

6. An electronic apparatus according to claim 5, wherein said calculation means calculates to equalize the amount of space for each partition.

7. An electronic apparatus according to claim 5, wherein said storage means stores right and left margin data.

8. An electronic apparatus according to claim 5, wherein said input means includes a keyboard.

9. An electronic apparatus comprising:

a keyboard for inputting character data;

first storage means for storing right and left margins;

second storage means for storing an accumulation of character pitch of the character data input by said keyboard;

calculating means for calculating a partition space based on the number of partitions, said right and left margins stored in said first storage means, and the accumulation of character pitch stored in said second storage means so as to determine a column layout;

tab position setting means for setting tab positions on the basis of said partition space, the accumulated character pitch of the character data and the right and left margins; and output means for outputting, while visually recognizing, said character data in accordance with the column layout determined by said calculating means.

10. An electronic apparatus according to claim 9, wherein said output means includes a printer.

11. An electronic apparatus according to claim 9, wherein said output means includes a display.

12. An electronic apparatus according to claim 9, further comprising control means for equalizing said partition space.

* * * * *

UNITED STATES PATENT AND TRADEMARK OFFICE

CERTIFICATE OF CORRECTION

PATENT NO. : 4,863,298
DATED : September 5, 1989
INVENTOR(S) : Tsutomu Takahashi

It is certified that error appears in the above-identified patent and that said Letters Patent is hereby corrected as shown below:

[57] AT ABSTRACT
Line 4, change "an" to --and--.

[56] AT REFERENCES CITED
Change "Subsytem"," to --Subsystem",--.

On the title page, and

COLUMN 1
Line 1, change "apparatus," to --apparatuses,--.

COLUMN 2
Line 12, change "FIG." to --FIGS--, and change "represents" to --represent--.
Line 49, change "of," to --of--.

COLUMN 3
Line 19, change "the setting" to --setting--.
Line 37, change "pitchs" to --pitches--.

Signed and Sealed this

Seventh Day of July, 1992

*Attest:*

DOUGLAS B. COMER

*Attesting Officer*

*Acting Commissioner of Patents and Trademarks*